US011776528B2

(12) United States Patent
Kang et al.

(10) Patent No.: US 11,776,528 B2
(45) Date of Patent: Oct. 3, 2023

(54) METHOD FOR CHANGING SPEED AND PITCH OF SPEECH AND SPEECH SYNTHESIS SYSTEM

(71) Applicant: Xinapse Co., Ltd., Seoul (KR)

(72) Inventors: Jinbeom Kang, Seoul (KR); Dong Won Joo, Seoul (KR); Yongwook Nam, Seoul (KR)

(73) Assignee: Xinapse Co., Ltd., Seoul (KR)

( * ) Notice: Subject to any disclaimer, the term of this patent is extended or adjusted under 35 U.S.C. 154(b) by 155 days.

(21) Appl. No.: 17/380,426

(22) Filed: Jul. 20, 2021

(65) Prior Publication Data

US 2022/0165250 A1 May 26, 2022

(30) Foreign Application Priority Data

Nov. 26, 2020 (KR) ..... 10-2020-0161131
Nov. 26, 2020 (KR) ..... 10-2020-0161140
Nov. 26, 2020 (KR) ..... 10-2020-0161141

(51) Int. Cl.

| | |
|---|---|
| ***G10L 13/033*** | (2013.01) |
| ***G10L 21/013*** | (2013.01) |
| ***G10L 25/45*** | (2013.01) |
| ***G10L 21/043*** | (2013.01) |
| ***G10L 21/14*** | (2013.01) |

(52) U.S. Cl.

CPC ..... *G10L 13/0335* (2013.01); *G10L 21/013* (2013.01); *G10L 21/043* (2013.01); *G10L 21/14* (2013.01); *G10L 25/45* (2013.01)

(58) Field of Classification Search

CPC ..... G10L 13/033; G10L 13/00; G10L 13/02; G10L 13/021; G10L 13/0335; G10L 13/04; G10L 13/08

USPC ..... 704/258, 259, 260, 265, 269, 278

See application file for complete search history.

(56) References Cited

U.S. PATENT DOCUMENTS

2008/0147413 A1* 6/2008 Sobol-Shikler ..... G10L 21/003 704/278
2010/0250242 A1* 9/2010 Li ..... G10L 25/48 704/E19.001
2022/0122579 A1* 4/2022 Biadsy ..... G10L 21/003

* cited by examiner

*Primary Examiner* — Qi Han

(74) *Attorney, Agent, or Firm* — Knobbe, Martens, Olson & Bear, LLP

(57) ABSTRACT

This application relates to a method of synthesizing a speech of which a speed and a pitch are changed. In one aspect, the method includes a spectrogram may be generated by performing a short-time Fourier transformation on a first speech signal based on a first hop length and a first window length, and speech signals of sections having a second window length at the interval of a second hop length from the spectrogram. A ratio between the first hop length and the second hop length may be set to be equal to the value of a playback rate and a ratio between the first window length and the second window length may be set to be equal to the value of a pitch change rate, thereby generating a second speech signal of which the speed and the pitch are changed.

4 Claims, 14 Drawing Sheets

METHOD FOR CHANGING SPEED AND PITCH OF SPEECH AND SPEECH SYNTHESIS SYSTEM

CROSS-REFERENCE TO RELATED APPLICATION

This application claims the benefit of Korean Patent Application Nos. 10-2020-0161131 filed on Nov. 26, 2020, 10-2020-0161140 filed on Nov. 26, 2020 and 10-2020-0161141 filed on Nov. 26, 2020, in the Korean Intellectual Property Office, the disclosures of all of which are incorporated herein in their entireties by reference.

BACKGROUND

Field

The present disclosure relates to a method for changing the speed and the pitch of a speech and a speech synthesis system.

Description of the Related Technology

Recently, along with the developments in the artificial intelligence technology, interfaces using speech signals are becoming common. Therefore, researches are being actively conducted on speech synthesis technology that enables a synthesized speech to be uttered according to a given situation.

The speech synthesis technology is applied to many fields, such as virtual assistants, audio books, automatic interpretation and translation, and virtual voice actors, in combination with speech recognition technology based on artificial intelligence.

SUMMARY

Provided is an artificial intelligence-based speech synthesis technique capable of implementing a natural speech like a speech of an actual speaker.

Provided is an artificial intelligence-based speech synthesis technique capable of freely changing a speed and a pitch of a speech signal synthesized from a text.

Additional aspects will be set forth in part in the description which follows and, in part, will be apparent from the description, or may be learned by practice of the presented embodiments.

According to an aspect of an embodiment, a method includes setting sections having a first window length based on a first hop length in a first speech signal; generating spectrograms by performing a short-time Fourier transformation on the sections; determining a playback rate and a pitch change rate for changing a speed and a pitch of the first speech signal, respectively; generating speech signals of sections having a second window length based on a second hop length from the spectrograms; and generating a second speech signal of which a speed and a pitch are changed on the speech signals of the sections, wherein a ratio between the first hop length and the second hop length is set to be equal to a value of the playback rate, and a ratio between the first window length and the second window length is set to be equal to a value of the pitch change rate.

Also, a value of the second hop length may correspond to a preset value, and the first hop length may be set to be equal to a value obtained by multiplying the second hop length by the playback rate.

Also, a value of the first window length may correspond to a preset value, and the second window length may be set to be equal to a value obtained by dividing the first window length by the pitch change rate.

Also, the generating of the speech signals of the sections having the second window length may includes estimating phase information by repeatedly performing a short-time Fourier transformation and an inverse short-time Fourier transformation on the spectrograms; and generating speech signals of the sections having the second window length based on the second hop length based on the phase information.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION

Figure 1:
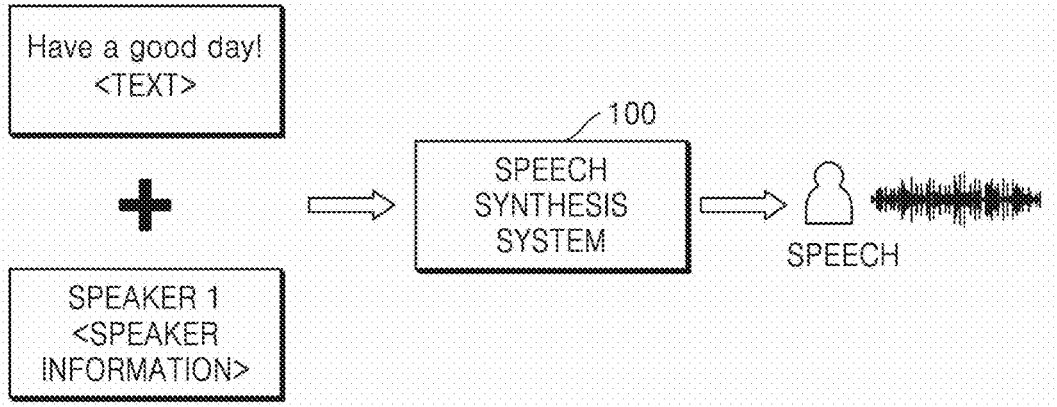
FIG. 1 is a diagram schematically showing the operation of a speech synthesis system.

Typical speech synthesis methods include various methods, such as a Unit Selection Synthesis (USS) and a HMM-based Speech Synthesis (HTS). The USS method is a method of cutting and storing speech data into phoneme units and finding and attaching suitable phonemes for a speech during speech synthesis. The HTS method is a method of extracting parameters corresponding to speech characteristics to generate a statistical model and reconstructing a text into a speech based on the statistical model. However, the above speech synthesis methods described above have many limitations in synthesizing a natural speech reflecting a speech style or an emotional expression of a speaker. Accordingly, recently, a speech synthesis method for synthesizing a speech from a text based on an artificial neural network is being spotlighted.

With respect to the terms in the various embodiments of the present disclosure, the general terms which are currently and widely used are selected in consideration of functions of structural elements in the various embodiments of the present disclosure. However, meanings of the terms may be changed according to intention, a judicial precedent, appearance of a new technology, and the like. In addition, in certain cases, a term which is not commonly used may be selected. In such a case, the meaning of the term will be described in detail at the corresponding part in the description of the present disclosure. Therefore, the terms used in the various embodiments of the present disclosure should be defined based on the meanings of the terms and the descriptions provided herein.

The present disclosure may include various embodiments and modifications, and embodiments thereof will be illustrated in the drawings and will be described herein in detail. However, this is not intended to limit the inventive concept to particular modes of practice, and it is to be appreciated that all changes, equivalents, and substitutes that do not depart from the spirit and technical scope of the inventive concept are encompassed in the present disclosure. The terms used in the present specification are merely used to describe particular embodiments, and are not intended to limit the present disclosure.

Terms used in the embodiments have the same meaning as commonly understood by one of ordinary skill in the art to which the embodiments belong, unless otherwise defined. Terms identical to those defined in commonly used dictionaries should be interpreted as having a meaning consistent with the meaning in the context of the related art and are not to be interpreted as ideal or overly formal in meaning unless explicitly defined in the present disclosure.

The detailed description of the present disclosure described below refers to the accompanying drawings, which illustrate specific embodiments in which the present disclosure may be practiced. These embodiments are described in detail sufficient to enable a one of ordinary skill in the art to practice the present disclosure. It should be understood that the various embodiments of the present disclosure are different from one another, but need not be mutually exclusive. For example, specific shapes, structures, and characteristics described in the present specification may be changed and implemented from one embodiment to another without departing from the spirit and scope of the present disclosure. In addition, it should be understood that positions or arrangement of individual elements in each embodiment may be changed without departing from the spirit and scope of the present disclosure. Therefore, the detailed descriptions to be given below are not made in a limiting sense, and the scope of the present disclosure should be taken as encompassing the scope claimed by the claims of the present disclosure and all scopes equivalent thereto. Like reference numerals in the drawings indicate the same or similar elements over several aspects.

Meanwhile, in the present specification, technical features that are individually described in one drawing may be implemented individually or at the same time.

Hereinafter, various embodiments of the present disclosure will be described in detail with reference to the accompanying drawings in order to enable one of ordinary skill in the art to easily implement the present disclosure.

FIG. 1 is a diagram schematically showing the operation of a speech synthesis system.

A speech synthesis system is a system that converts text into human speech.

For example, the speech synthesis system 100 of FIG. 1 may be a speech synthesis system based on an artificial neural network. The artificial neural network refers to all models in which artificial neurons constituting a network through synaptic bonding have problem-solving ability by changing the strength of the synaptic bonding through learning.

The speech synthesis system 100 may be implemented as various types of devices, such as a personal computer (PC), a server device, a mobile device, and an embedded device, and, as specific examples, may correspond to, but are not limited to, a smartphone, a tablet device, an augmented reality (AR) device, an Internet of Things (IoT) device, an autonomous vehicle, a robotics, a medical device, an e-book terminal, and a navigation device that performs speech synthesis using an artificial neural network.

Furthermore, the speech synthesis system 100 may correspond to a dedicated hardware (HW) accelerator mounted on the above-stated devices. Alternatively, the speech synthesis system 100 may be, but is not limited to, a HW accelerator, such as a neural processing unit (NPU), a tensor processing unit (TPU), and a neural engine, which is a dedicated module for driving an artificial neural network.

Referring to FIG. 1, the speech synthesis system 100 may receive a text input and specific speaker information. For example, the speech synthesis system 100 may receive "Have a good day!" as a text input shown in FIG. 1 and may receive "Speaker 1" as a speaker information input.

"Speaker 1" may correspond to a speech signal or a speech sample indicating speech characteristics of a preset speaker 1. For example, speaker information may be received from an external device through a communication unit included in the speech synthesis system 100. Alternatively, speaker information may be input from a user through a user interface of the speech synthesis system 100 and may be selected as one of various speaker information previously stored in a database of the speech synthesis system 100, but the present disclosure is limited thereto.

The speech synthesis system 100 may output a speech based on a text input received and specific speaker information received as inputs. For example, the speech synthesis system 100 may receive "Have a good day!" and "Speaker 1" as inputs and output a speech for "Have a good day!" reflecting the speech characteristics of the speaker 1. The speech characteristic of the speaker 1 may include at least one of various factors, such as a voice, a prosody, a pitch, and an emotion of the speaker 1. In other word, the output speech may be a speech that sounds like the speaker 1 naturally pronouncing "Have a good day!". Detailed operations of the speech synthesis system 100 will be described later with reference to FIGS. 2 to 4.

Figure 2:
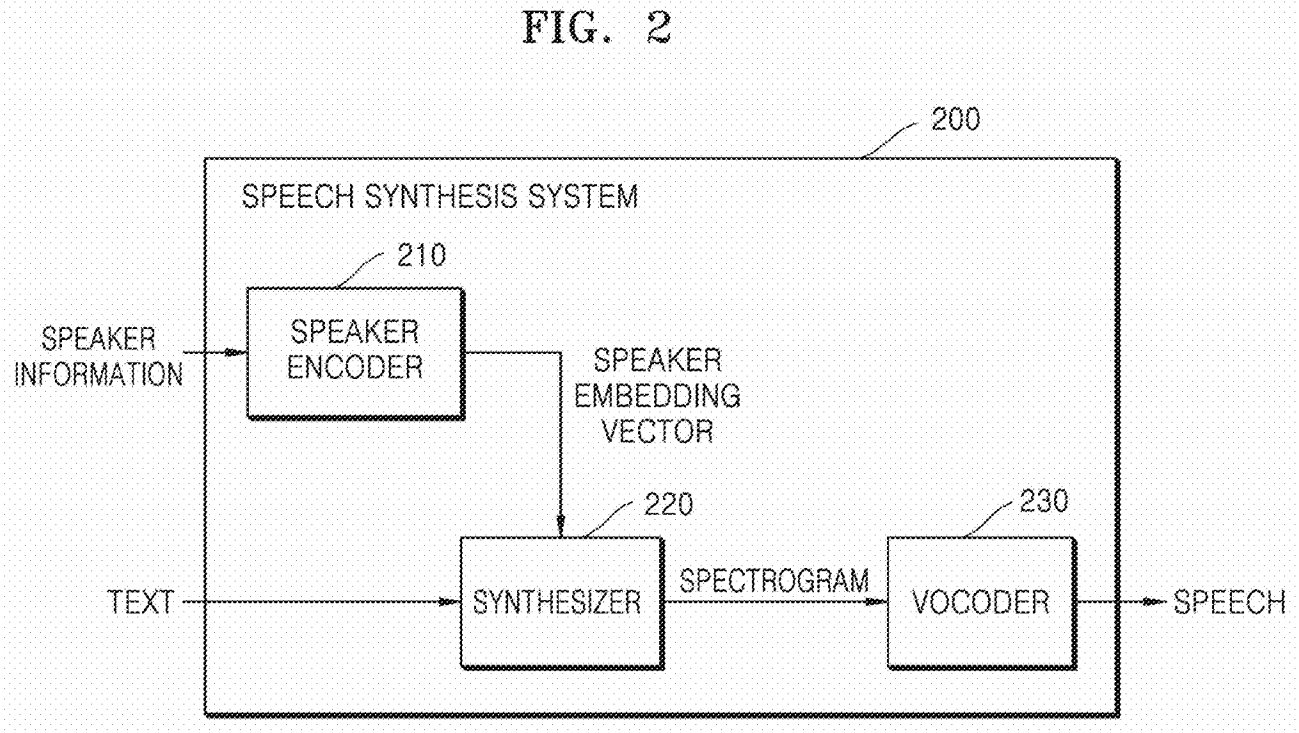
FIG. 2 is a diagram showing an embodiment of a speech synthesis system.

FIG. 2 is a diagram showing an embodiment of a speech synthesis system. A speech synthesis system 200 of FIG. 2 may be the same as the speech synthesis system 100 of FIG. 1.

Referring to FIG. 2, the speech synthesis system 200 may include a speaker encoder 210, a synthesizer 220, and a vocoder 230. Meanwhile, in the speech synthesis system 200 shown in FIG. 2, only components related to an embodiment are shown. Therefore, it would be obvious to one of ordinary skill in the art that the speech synthesis system 200 may further include other general-purpose components in addition to the components shown in FIG. 2.

The speech synthesis system 200 of FIG. 2 may receive speaker information and a text as inputs and output a speech.

For example, the speaker encoder 210 of the speech synthesis system 200 may receive speaker information as an input and generate a speaker embedding vector. The speaker information may correspond to a speech signal or a speech sample of a speaker. The speaker encoder 210 may receive a speech signal or a speech sample of a speaker, extract speech characteristics of the speaker, and represent the same as an embedding vector.

The speech characteristics may include at least one of various factors, such as a speech speed, a pause period, a pitch, a tone, a prosody, an intonation, and an emotion. In other words, the speaker encoder 210 may represent discontinuous data values included in the speaker information as a vector including consecutive numbers. For example, the speaker encoder 210 may generate a speaker embedding vector based on at least one of or a combination of two or more of various artificial neural network models, such as a pre-net, a CBHG module, a deep neural network (DNN), a convolutional neural network (CNN), a recurrent neural network (RNN), a long short-term memory network (LSTM), and a bidirectional recurrent deep neural network (BRDNN).

For example, the synthesizer 220 of the speech synthesis system 200 may receive a text and an embedding vector representing the speech characteristics of a speaker as inputs and output a spectrogram.

Figure 3:
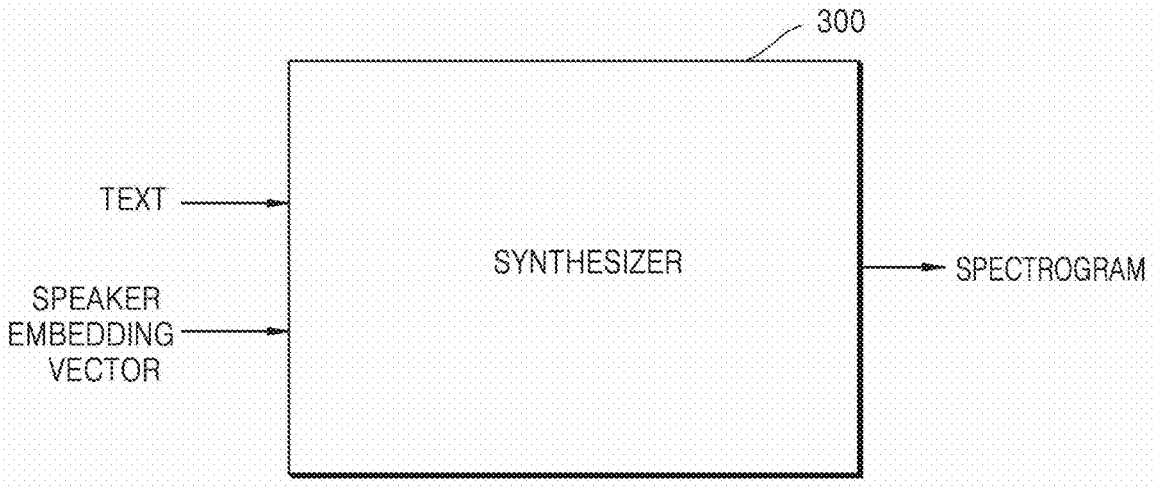
FIG. 3 is a diagram showing an embodiment of a synthesizer of a speech synthesis system.

FIG. 3 is a diagram showing an embodiment of a synthesizer 300 of a speech synthesis system. The synthesizer 300 of FIG. 3 may be the same as the synthesizer 220 of FIG. 2.

Referring to FIG. 3, the synthesizer 300 of the speech synthesis system 200 may include a text encoder and a decoder. Meanwhile, it would be obvious to one of ordinary skill in the art that the synthesizer 300 may further include other general-purpose components in addition to the components shown in FIG. 3.

An embedding vector representing the speech characteristics of a speaker may be generated by the speaker encoder 210 as described above, and an encoder or a decoder of the synthesizer 300 may receive the embedding vector representing the speech characteristics of the speaker from the speaker encoder 210.

The text encoder of the synthesizer 300 may receive text as an input and generate a text embedding vector. A text may include a sequence of characters in a particular natural language. For example, a sequence of characters may include alphabetic characters, numbers, punctuation marks, or other special characters.

The text encoder may divide an input text into letters, characters, or phonemes and input the divided text into an artificial neural network model. For example, the text encoder may generate a text embedding vector based on at least one of or a combination of two or more of various artificial neural network models, such as a pre-net, a CBHG module, a DNN, a CNN, an RNN, an LSTM, and a BRDNN.

Alternatively, the text encoder may divide an input text into a plurality of short texts and may generate a plurality of text embedding vectors in correspondence to the respective short texts.

The decoder of the synthesizer 300 may receive a speaker embedding vector and a text embedding vector as inputs from the speaker encoder 210. Alternatively, the decoder of the synthesizer 300 may receive a speaker embedding vector as an input from the speaker encoder 210 and may receive a text embedding vector as an input from the text encoder.

The decoder may generate a spectrogram corresponding to the input text by inputting the speaker embedding vector and the text embedding vector into an artificial neural network model. In other words, the decoder may generate a spectrogram for the input text in which the speech characteristics of a speaker are reflected. For example, the spectrogram may correspond to a mel-spectrogram, but is not limited thereto.

A spectrogram is a graph that visualizes the spectrum of a speech signal. The x-axis of the spectrogram represents time, the y-axis represents frequency, and values of respective frequencies per time may be expressed in colors according to the sizes of the values. The spectrogram may be a result of performing a short-time Fourier transformation (STFT) on speech signals which are consecutively provided.

The STFT is a method of dividing a speech signal into sections of a certain length and applying a Fourier transformation to each section. In this case, since a result of performing the STFT on a speech signal is a complex value, phase information may be lost by taking an absolute value for the complex value, and a spectrogram including only magnitude information may be generated.

On the other hand, the mel-spectrogram is a result of re-adjusting a frequency interval of the spectrogram to a mel-scale. Human auditory organs are more sensitive in a low frequency band than in a high frequency, and the mel-scale expresses the relationship between physical frequencies and frequencies actually perceived by a person by reflecting the characteristic. A mel-spectrogram may be generated by applying a filter bank based on the mel-scale to a spectrogram.

Meanwhile, although not shown in FIG. 3, the synthesizer 300 may further include an attention module for generating an attention alignment. The attention module is a module that learns to which output from among outputs of all time-steps of an encoder an output of a specific time-step of a decoder is most related. A higher quality spectrogram or mel-spectrogram may be output by using the attention module.

Figure 4:
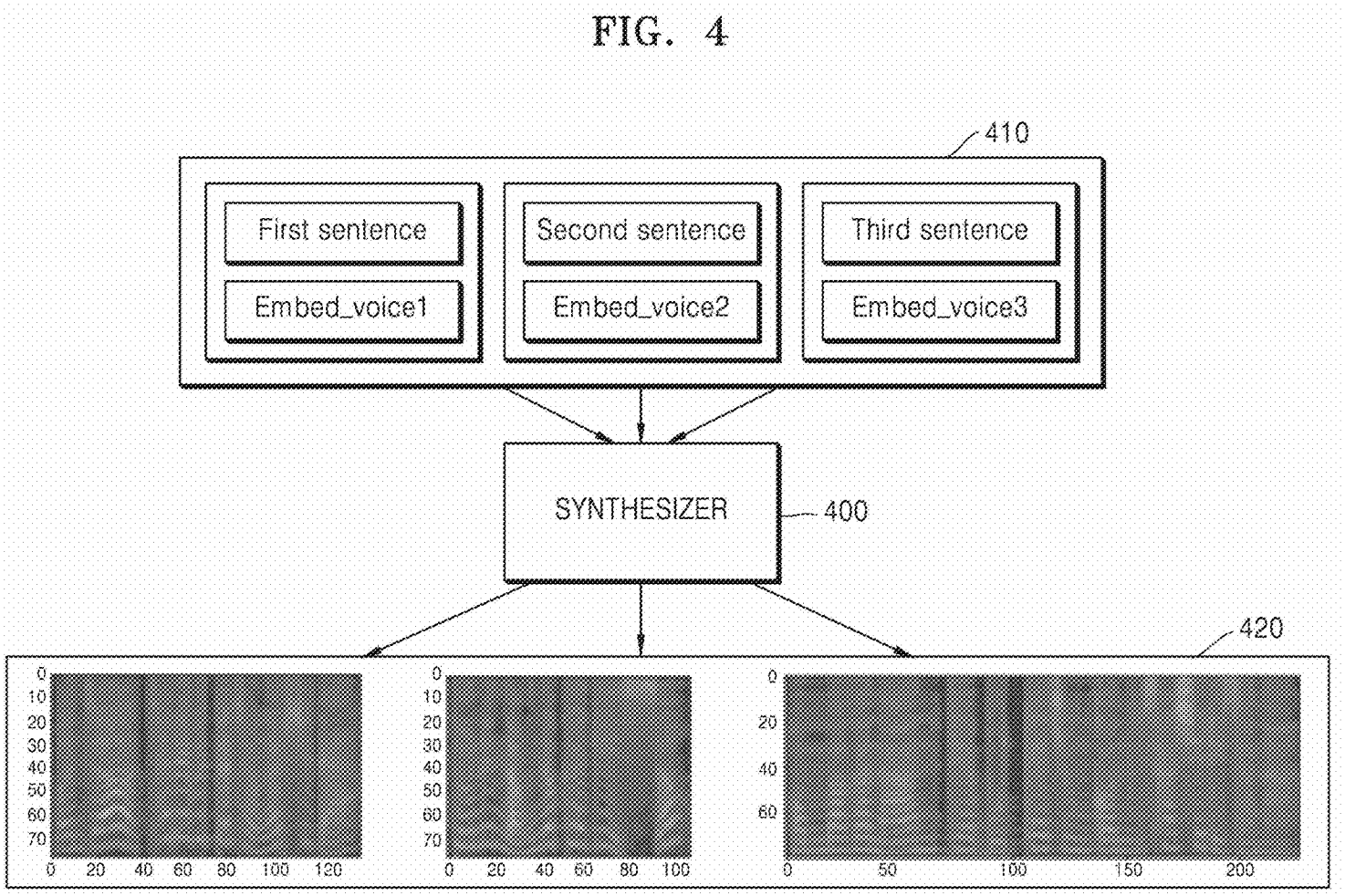
FIG. 4 is a diagram showing an embodiment of outputting a mel-spectrogram through a synthesizer.

FIG. 4 is a diagram showing an embodiment of outputting a mel-spectrogram through a synthesizer. A synthesizer 400 of FIG. 4 may be the same as the synthesizer 300 of FIG. 3.

Referring to FIG. 4, the synthesizer 400 may receive a list including input texts and speaker embedding vectors corresponding thereto. For example, the synthesizer 400 may receive a list 410 including an input text 'first sentence', a speaker embedding vector embed_voice1 corresponding thereto, an input text 'second sentence', a speaker embedding vector embed_voice2 corresponding thereto, and an input text 'third sentence', and a speaker embedding vector embed_voice3 corresponding thereto as an input.

The synthesizer 400 may generate mel-spectrograms 420 as many as the number of input texts included in the received list 410. Referring to FIG. 4, it may be seen that mel-spectrograms corresponding to input texts 'first sentence', 'second sentence', and 'third sentence' are generated.

Alternatively, the synthesizer 400 may generate a mel-spectrogram 420 and an attention alignment of each of the input texts. Although not shown in FIG. 4, for example, attention alignments respectively corresponding to the input texts 'first sentence', 'second sentence', and 'third sentence' may be additionally generated. Alternatively, the synthesizer 400 may generate a plurality of mel-spectrograms and a plurality of attention alignments for each of the input texts.

Returning back to FIG. 2, the vocoder 230 of the speech synthesis system 200 may generate a spectrogram output from the synthesizer 220 into an actual speech. As described above, the spectrogram output from the synthesizer 220 may be a mel-spectrogram.

In an embodiment, the vocoder 230 may generate a spectrogram output from the synthesizer 220 as an actual speech signal by using an inverse short-time Fourier transformation (ISTFT). Since the spectrogram or the mel-spectrogram does not include phase information, when a speech signal is generated by using the ISTFT, phase information of the spectrogram or the mel-spectrogram is not considered.

In another embodiment, the vocoder 230 may generate a spectrogram output from the synthesizer 220 as an actual speech signal by using a Griffin-Lim algorithm. The Griffin-Lim algorithm is an algorithm that estimates phase information from size information of a spectrogram or a mel-spectrogram.

Alternatively, the vocoder 230 may generate a spectrogram output from the synthesizer 220 as an actual speech signal based on, for example, a neural vocoder.

The neural vocoder is an artificial neural network model that receives a spectrogram or a mel-spectrogram as an input and generates a speech signal. The neural vocoder may learn the relationship between a spectrogram or a mel-spectrogram and a speech signal through a large amount of data, thereby generating a high-quality actual speech signal.

The neural vocoder may correspond to a vocoder based on an artificial neural network model such as a WaveNet, a Parallel WaveNet, a WaveRNN, a WaveGlow, or a MelGAN, but is not limited thereto.

For example, a WaveNet vocoder includes a plurality of dilated causal convolution layers and is an autoregressive model that uses sequential characteristics between speech samples. A WaveRNN vocoder is an autoregressive model that replaces a plurality of dilated causal convolution layers of a WaveNet with a Gated Recurrent Unit (GRU). A WaveGlow vocoder may learn to produce a simple distribution, such as a Gaussian distribution, from a spectrogram dataset (x) by using an invertible transformation function. The WaveGlow vocoder may output a speech signal from a Gaussian distribution sample by using the inverse function of a transform function after learning is completed.

Figure 5:
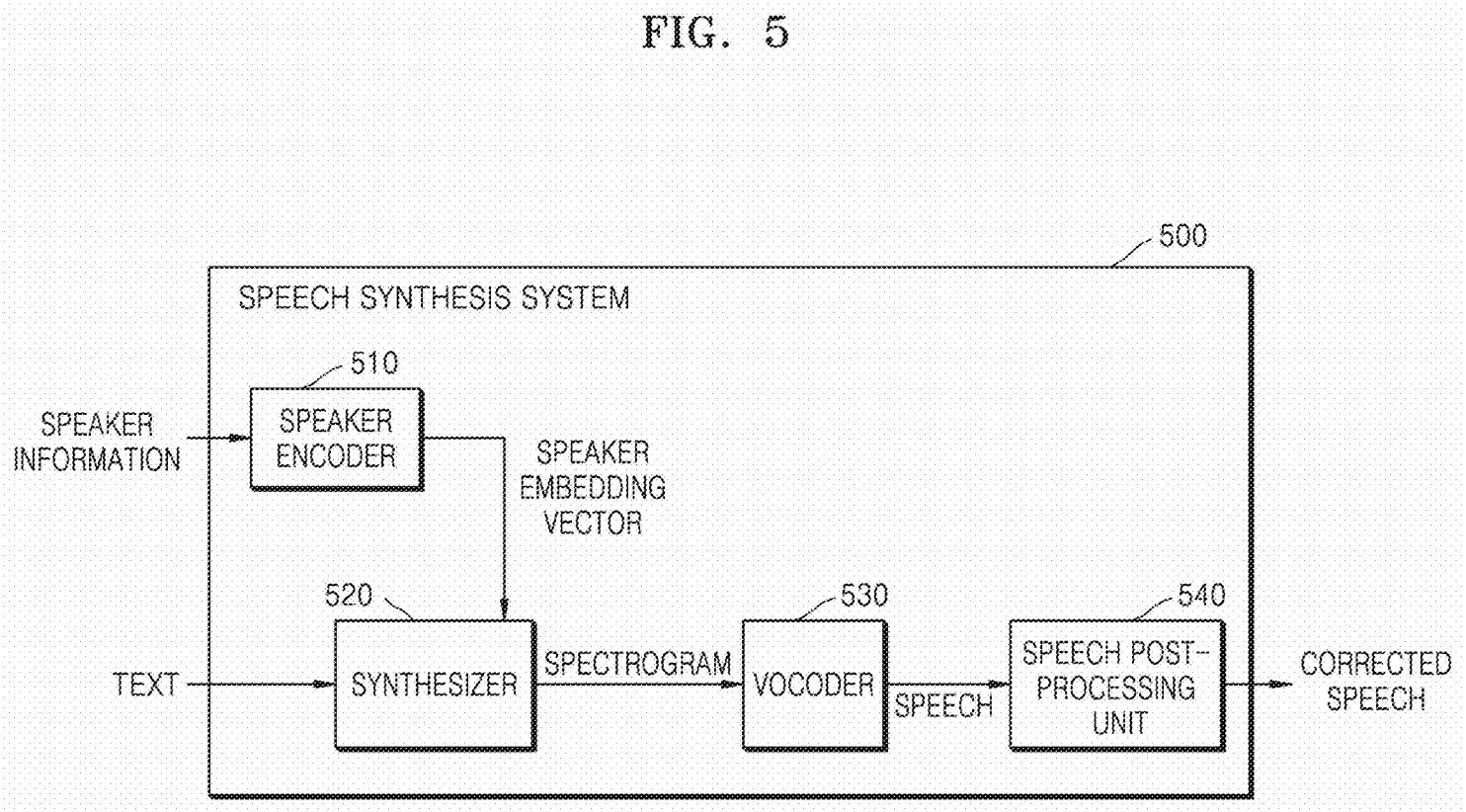
FIG. 5 is a diagram showing an embodiment of a speech synthesis system.

FIG. 5 is a diagram showing an embodiment of a speech synthesis system. A speech synthesis system 500 of FIG. 5 may be the same as the speech synthesis system 100 of FIG. 1 or the speech synthesis system 200 of FIG. 2.

Referring to FIG. 5, a speech synthesis system 500 may include a speaker encoder 510, a synthesizer 520, a vocoder 530, and a speech post-processing unit 540. Meanwhile, in the speech synthesis system 500 shown in FIG. 5, only components related to an embodiment are shown. Therefore, it would be obvious to one of ordinary skill in the art that the speech synthesis system 500 may further include other general-purpose components in addition to the components shown in FIG. 5.

The speaker encoder 510, the synthesizer 520, and the vocoder 530 of FIG. 5 may be the same as the speaker encoder 210, the synthesizer 220, and the vocoder 230 of FIG. 2 described above, respectively. Therefore, descriptions of the speaker encoder 510, the synthesizer 520, and the vocoder 530 of FIG. 5 will be omitted.

As described above, the synthesizer 520 may generate a spectrogram or a mel-spectrogram by inputting a text and a speaker embedding vector received from the speaker encoder 510 as inputs. Also, the vocoder 530 may generate an actual speech by using a spectrogram or a mel-spectrogram as an input.

The speech post-processing unit 540 of FIG. 5 may receive a speech generated by the vocoder 530 as an input and perform a post-processing task, such as noise removal, audio stretching, or pitch shifting. The voice post-processing unit 540 may perform a post-processing task on an input speech and generate a corrected speech to be finally played back to a user.

For example, the speech post-processing unit 540 may correspond to a phase vocoder, but is not limited thereto. The phase vocoder corresponds to a vocoder capable of controlling the frequency domain and the time domain of a voice by using phase information.

The phase vocoder may perform a STFT on an input speech signal and convert a speech signal in the time domain into a speech signal in the time-frequency domain. As described above in FIG. 2, since the STFT divides a speech signal into several sections of a short time and performs Fourier transform for each section, it is possible to check frequency characteristics that change over time.

Alternatively, since a converted speech signal in the time-frequency domain has a complex value, the phase vocoder may generate a spectrogram including only size information by taking an absolute value for the complex value. Alternatively, the phase vocoder may generate a mel-spectrogram by re-adjusting the frequency interval of the spectrogram to a mel-scale.

The phase vocoder may perform post-processing tasks, such as noise removal, audio stretching, or pitch change, by using a converted speech signal in the time-frequency domain or a spectrogram.

Figure 6:
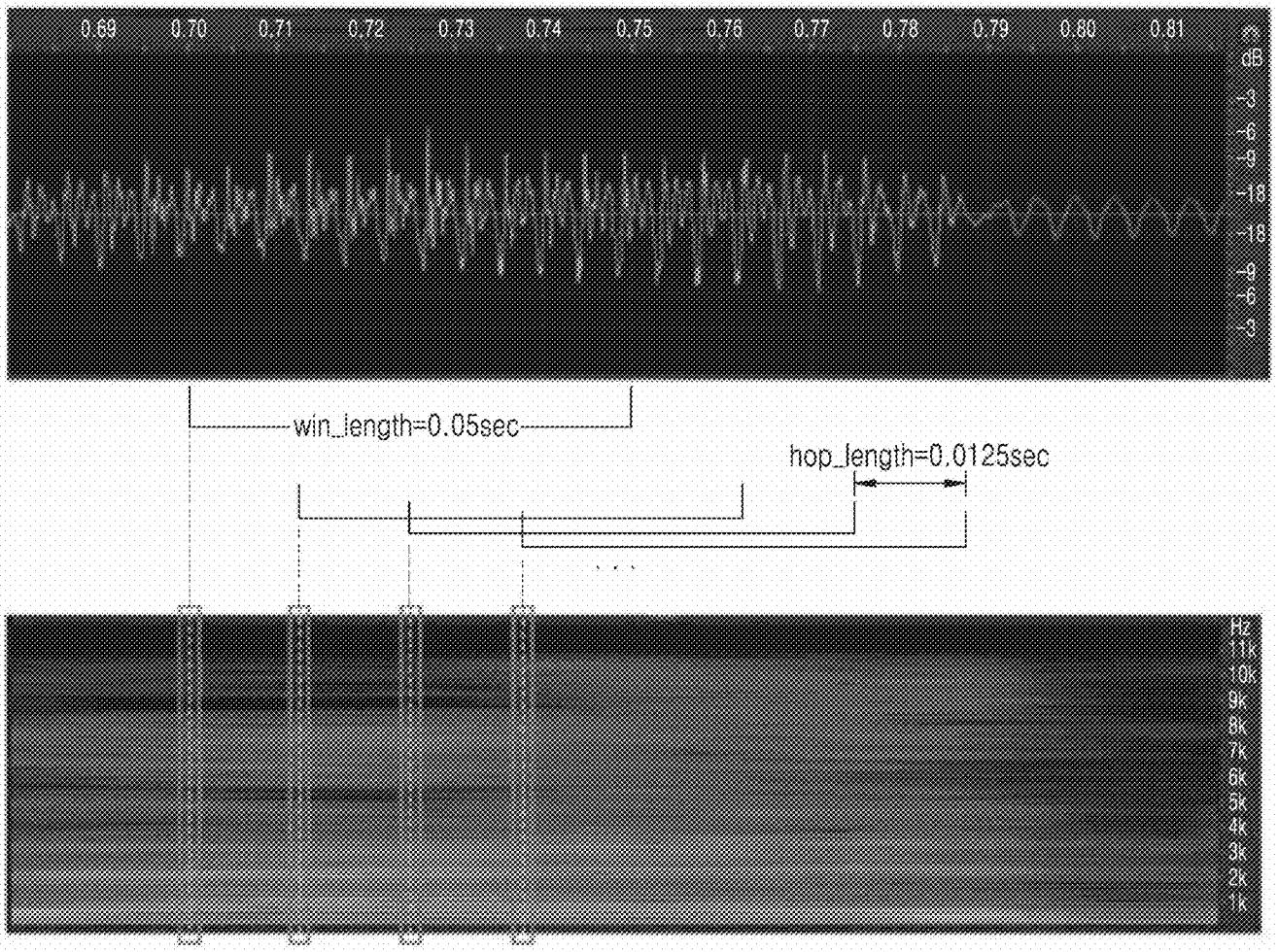
FIG. 6 is a diagram showing an embodiment of performing a STFT on an input speech signal.

FIG. 6 is a diagram showing an embodiment of performing a STFT on a speech signal.

Referring to FIG. 6, the speech post-processing unit 540 may divide the domain speech signal in the time domain into sections having a certain window length and perform a Fourier transformation for each section. Therefore, a converted speech signal in the time-frequency domain or a spectrogram may be generated for each section. FIG. 6 shows that a spectrogram is generated by performing a Fourier transform for each section. In this case, a spectrogram may correspond to a mel-spectrogram. Meanwhile, the window length may be set to a value equal to a Fast Fourier Transform (FFT) size indicating the number of samples to be subjected to a Fourier transformation, but the present disclosure is not limited thereto.

Meanwhile, in consideration of a trade-off relationship between a frequency resolution and a temporal resolution, a hop length may be set, such that sections having a certain window length overlap.

For example, when the value of a sampling rate is 24000 and the window length is 0.05 seconds, a Fourier transform may be performed by using 1200 samples for each section. Also, when the hop length is 0.0125 seconds, a length between sections having a first window length may correspond to 0.0125 seconds.

The phase vocoder may perform a post-processing task on a spectrogram generated as described above and output a final speech by using an ISTFT. Alternatively, the phase vocoder may perform a post-processing task on a spectrogram generated as described above and output a final speech by using the Griffin-Lim algorithm.

Figure 7:
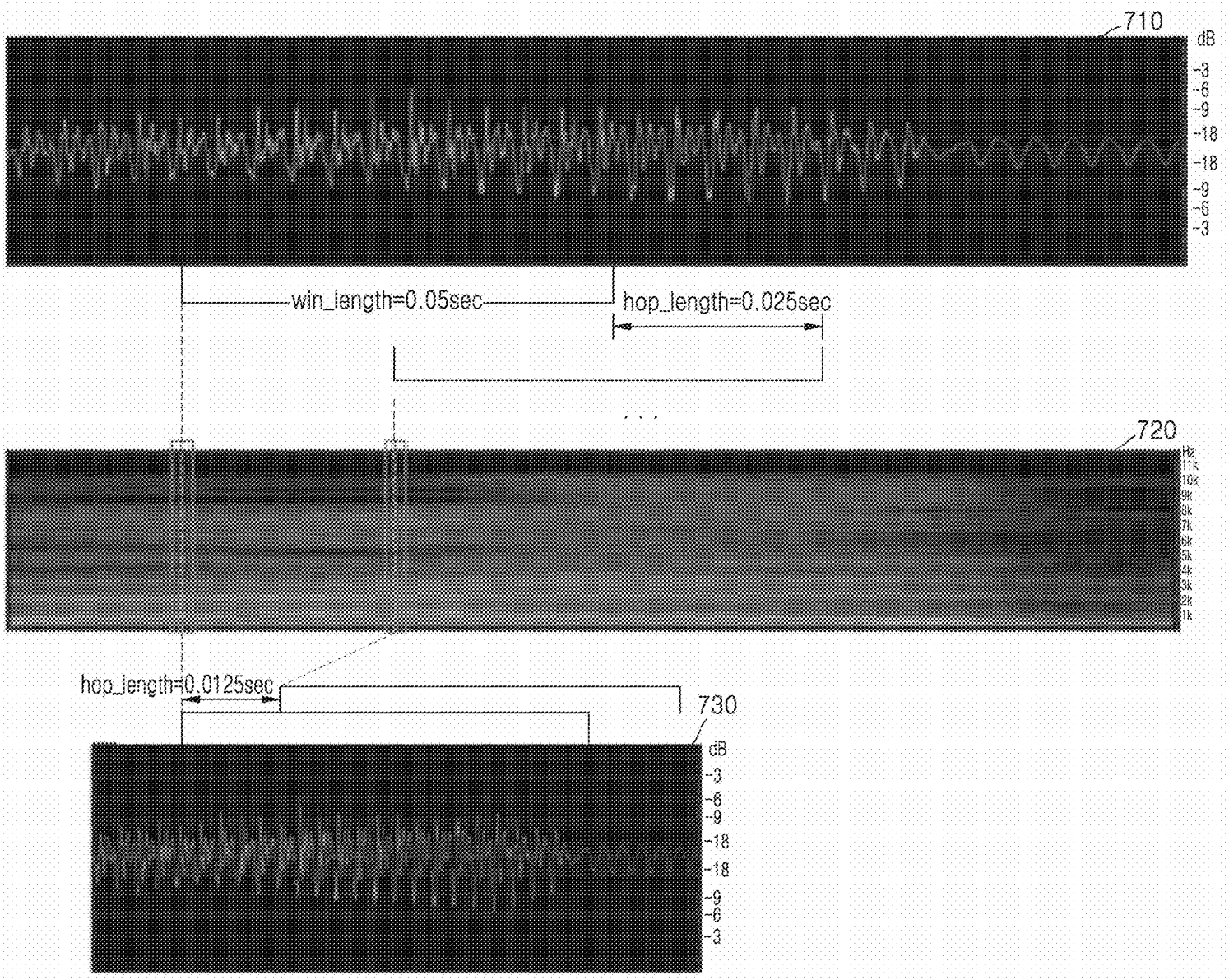
FIG. 7 is a diagram showing an embodiment of changing a speed in a speech post-processing unit.

FIG. 7 is a diagram showing an embodiment of changing a speed in a speech post-processing unit.

The speech post-processing unit 540 of FIG. 5 described above may change the speed of a speech generated by the vocoder 530, which is also referred to as audio stretching. The audio stretching is to change the speed or the playback time of a speech signal without affecting the pitch of the speech signal.

The speech post-processing unit 540 may generate a spectrogram from a speech generated by the vocoder 530 and change the speed of the speech in the process of restoring a generated spectrogram back to a speech.

Referring to FIG. 7, the speech post-processing unit 540 may perform a STFT on a first speech signal 710 generated by the vocoder 530. A spectrogram 720 of FIG. 7 may correspond to a spectrogram generated by performing a STFT on the first speech signal 710 generated by the vocoder 530. For example, the spectrogram 720 of FIG. 7 may correspond to a mel-spectrogram.

For example, the speech post-processing unit 540 may set sections having a first window length based on a first hop length in the first speech signal 710 generated by the vocoder 530. The first hop length may correspond to a length between sections having the first window length.

For example, referring to FIG. 7, when the value of the sampling rate is 24000, the first window length may be 0.05 seconds, and the first hop length may be 0.025 seconds. In this case, the speech post-processing unit 540 may perform a Fourier transform by using 1200 samples for each section.

The speech post-processing unit 540 may generate a speech signal in the time-frequency domain by performing a STFT on divided sections as described above and generate the spectrogram 720 based on the speech signal in the time-frequency domain. In detail, since the speech signal in the time-frequency domain has a complex value, phase information may be lost by taking an absolute value for the complex value, thereby generating the spectrogram 720 including only size information. In this case, the spectrogram 720 may correspond to a mel-spectrogram.

Meanwhile, the speech post-processing unit 540 may determine a playback rate to change the speed of the first speech signal 710 generated by the vocoder 530. For example, to generate a speech that is twice as fast as the speed of the first speech signal 710 generated by the vocoder 530, the playback rate may be determined to 2.

The speech post-processing unit 540 may generate speech signals of sections having a second window length based on a second hop length from the spectrogram 720. For example, the speech post-processing unit 540 may estimate phase information by repeatedly performing a STFT and an inverse short-time Fourier transform on the spectrogram 720 and generate speech signals of the sections based on estimated phase information. The speech post-processing unit 540 may generate a second speech signal 730 whose speed is changed based on the speech signals of the sections.

To change the speed of the first speech signal 710, the speech post-processing unit 540 may set a ratio between the first hop length and a second hop length to be equal to the playback rate. For example, the second hop length may correspond to a preset value, and the first hop length may be set to be equal to a value obtained by multiplying the second hop length by the playback rate. Alternatively, the first hop length may correspond to a preset value, and the second hop length may be set to be equal to a value obtained by dividing the first hop length by the playback rate. Meanwhile, the first window length and the second window length may be the same, but are not limited thereto.

For example, referring to FIG. 7, the second window length may be 0.05 seconds, which is equal to the first window length, and the second hop length may be 0.0125 seconds. FIG. 7 shows a process of generating a speech that is twice as fast as the speed of the first speech signal 710, and it may be seen that the ratio between the first hop length and the second hop length is set to be equal to 2.

The speech post-processing unit 540 may generate the second speech signal 730 whose speed and pitch are changed based on speech signals of sections having the second window length based on the second hop length. A corrected speech signal may correspond to a speech signal in which the speed of the first speech signal 710 is changed according to the playback rate. Referring to FIG. 7, it may be seen that the second speech signal 730 that is twice as fast as the speed of the first speech signal 710 is generated.

Figure 8A:
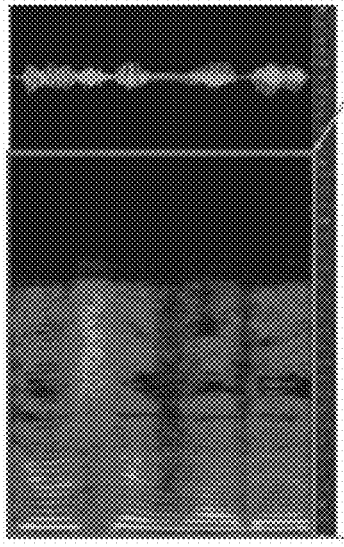
FIG. 8A, FIG. 8B and FIG. 8C are diagrams showing an embodiment of changing a pitch in a speech post-processing unit.
Figure 8B:
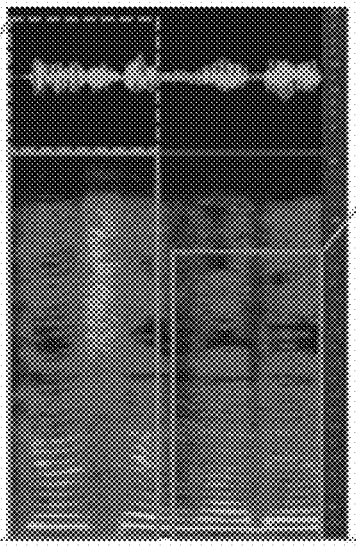
Figure 8C:
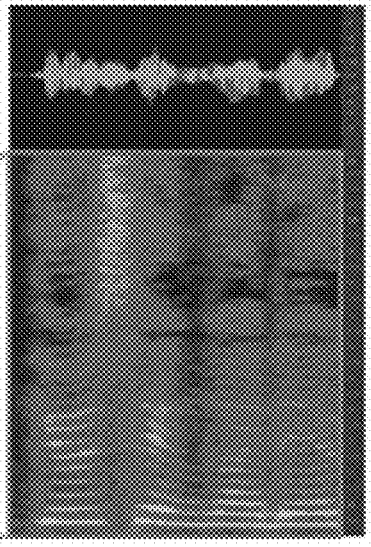

FIG. 8A, FIG. 8B and FIG. 8C are diagrams showing an embodiment of changing a pitch in a speech post-processing unit.

The speech post-processing unit 540 of FIG. 5 described above may change the pitch of a speech generated by the vocoder 530, which is also referred to as pitch shifting. The pitch shifting is to change the pitch of a speech signal without affecting the speed or the playback time of the speech signal.

The speech post-processing unit 540 may generate a spectrogram from a speech generated by the vocoder 530 and change the pitch of the speech in the process of restoring a generated spectrogram back to a speech.

As described above in FIG. 7, the speech post-processing unit 540 may generate a spectrogram or a mel-spectrogram by performing a STFT on a first speech signal generated by the vocoder 530.

For example, the speech post-processing unit 540 may set sections having the first window length based on the first hop length in the vocoder 530.

For example, when the value of the sampling rate is 24000, the first window length may be 0.05 seconds, and the first hop length may be 0.0125 seconds.

The speech post-processing unit 540 may generate a speech signal in the time-frequency domain by performing a STFT on divided sections and generate a spectrogram or a mel-spectrogram based on the speech signal in the time-frequency domain.

Meanwhile, the speech post-processing unit 540 may determine a pitch change rate to change the pitch of the first speech signal. For example, to generate a speech having a pitch 1.25 times higher than the pitch of the first speech signal, the pitch change rate may be determined to 1.25.

The speech post-processing unit 540 may generate speech signals of sections having a second window length based on a second hop length from a spectrogram. For example, the speech post-processing unit 540 may estimate phase information by repeatedly performing a STFT and an ISTFT on a spectrogram and generate speech signals of the sections based on estimated phase information. The speech post-processing unit 540 may generate a second speech signal whose pitch is changed based on the speech signals of the sections.

To change the pitch of the first speech signal, the speech post-processing unit 540 may set a ratio between the first window length and the second window length to be equal to the pitch change rate. For example, the first window length may correspond to a preset value, and the second window length may be set to be equal to a value obtained by dividing the first window length by the pitch change rate. Alternatively, the second window length may correspond to a preset value, and the first window length may be set to be equal to a value obtained by multiplying the second window length by the pitch change rate. Meanwhile, the first hop length and the second hop length may be the same, but are not limited thereto.

For example, FIG. 8B shows a first speech signal generated by the vocoder 530 and a spectrogram generated by performing a STFT with the sampling rate of 24000, the first window length of 0.05 seconds, and the first hop length of 0.0125 seconds on the first speech signal. The generated spectrogram may have a frequency arrangement of 601 frequency components up to 12000 hz at the interval of 20 hz.

On the other hand, when the pitch change rate is 1.25, since frequency components of 9600 hz or higher become 12000 hz after a pitch change, the frequency components of 9600 hz or higher may be lost. Therefore, a pitch change may be performed only for frequency components of 9600 hz or lower, and a frequency arrangement of 481 frequency components may be obtained up to 9600 hz at the interval of 20 hz. In other words, when generating a speech signal whose pitch is corrected by 1.25 times from a spectrogram, to use only the frequency arrangement of 601 frequency components, the second window length may be set to 0.04 seconds, which is a value obtained by dividing the value of the first window length by the pitch change rate 1.25. FIG. 8C may represent a second speech signal whose pitch is changed by 1.25 times by generating speech signals of sections having the second window length of 0.04 seconds based on the second hop length of 0.0125 seconds for the spectrogram of FIG. 8B and changing the pitch of the second speech signal based on the speech signals of the sections.

Alternatively, when the pitch change rate is 0.75, to increase the size of the frequency arrangement of 601 frequency components to a frequency arrangement of 801 frequency components, the remaining 200 frequency components may be zero-padded. Accordingly, the second window length may be set as a value obtained by dividing the value of the first window length by the pitch change rate of 0.75. FIG. 8A may represent a second speech signal obtained by changing the pitch of the speech signal of FIG. 8B by 0.75 times.

As described above, to correct the speed of the first speech signal generated by the vocoder 530, the ratio between the first hop length and the second hop length may be set to be equal to the value of the playback rate. Also, to correct the pitch of the first speech signal generated by the vocoder 530, the ratio between the first window length and the second window length may be set to be equal to the value of the pitch change rate.

By combining these, the speed and the pitch of the first speech signal generated by the vocoder 530 may be simultaneously corrected. For example, when the ratio between the first hop length and the second hop length is set to be equal to the value of the playback rate and the ratio between the first window length and the second window length is set to be equal to the value of the pitch change rate, the speed of the speech signal may be changed according to the playback rate and the pitch of the first speech signal may be changed according to the pitch change rate.

Figure 9:
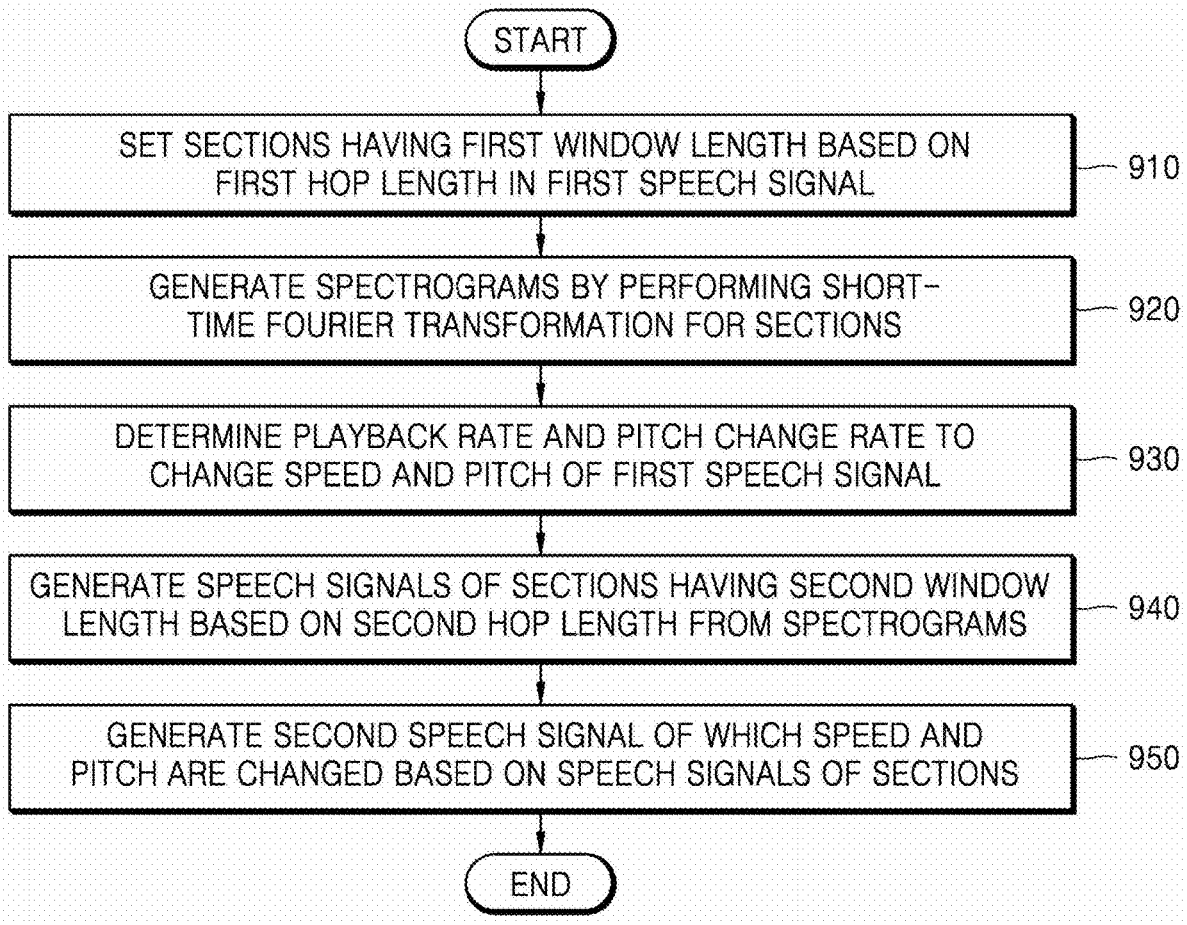
FIG. 9 is a flowchart showing an embodiment of a method of changing the speed and the pitch of a speech signal.

FIG. 9 is a flowchart showing an embodiment of a method of changing the speed and the pitch of a speech signal.

Referring to FIG. 9, in operation 910, a speech post-processing unit may set sections having a first window length based on a first hop length in a first speech signal.

In operation 920, the speech post-processing unit may generate a spectrogram by performing a STFT on the sections.

For example, the speech post-processing unit may generate a speech signal in the time-frequency domain by performing a Fourier transform on each section. The speech post-processing unit may take an absolute value from a speech signal in the time-frequency domain, thereby losing phase information and generating a spectrogram including only size information.

In operation 930, the speech post-processing unit may determine a playback rate and a pitch change rate for changing the speed and the pitch of a first speech signal. For example, to generate a speech that is twice as fast as the speed of the first speech signal generated by a vocoder, the playback rate may be determined to 2. Alternatively, to generate a speech having a pitch 1.25 times higher than the pitch of the first speech signal generated by the vocoder, the pitch change rate may be determined to 1.25.

In operation 940, the speech post-processing unit may generate speech signals of sections having a second window length based on a second hop length from a spectrogram.

For example, the speech post-processing unit may estimate phase information by repeatedly performing a STFT and an ISTFT on the spectrogram. For example, the speech post-processing unit may use a Griffin-Lim algorithm, but the present disclosure is not limited thereto. Based on estimated phase information, the speech post-processing unit may generate speech signals of sections having a second window length based on a second hop length.

In operation 950, the speech post-processing unit may generate a second speech signal whose speed and pitch are changed based on the speech signals of the sections.

For example, the speech post-processing unit may finally generate a second speech signal in which the speed and the pitch of the first speech signal are changed according to the playback rate and the pitch change rate, respectively, by summing all the speech signals of the sections.

Figure 10:
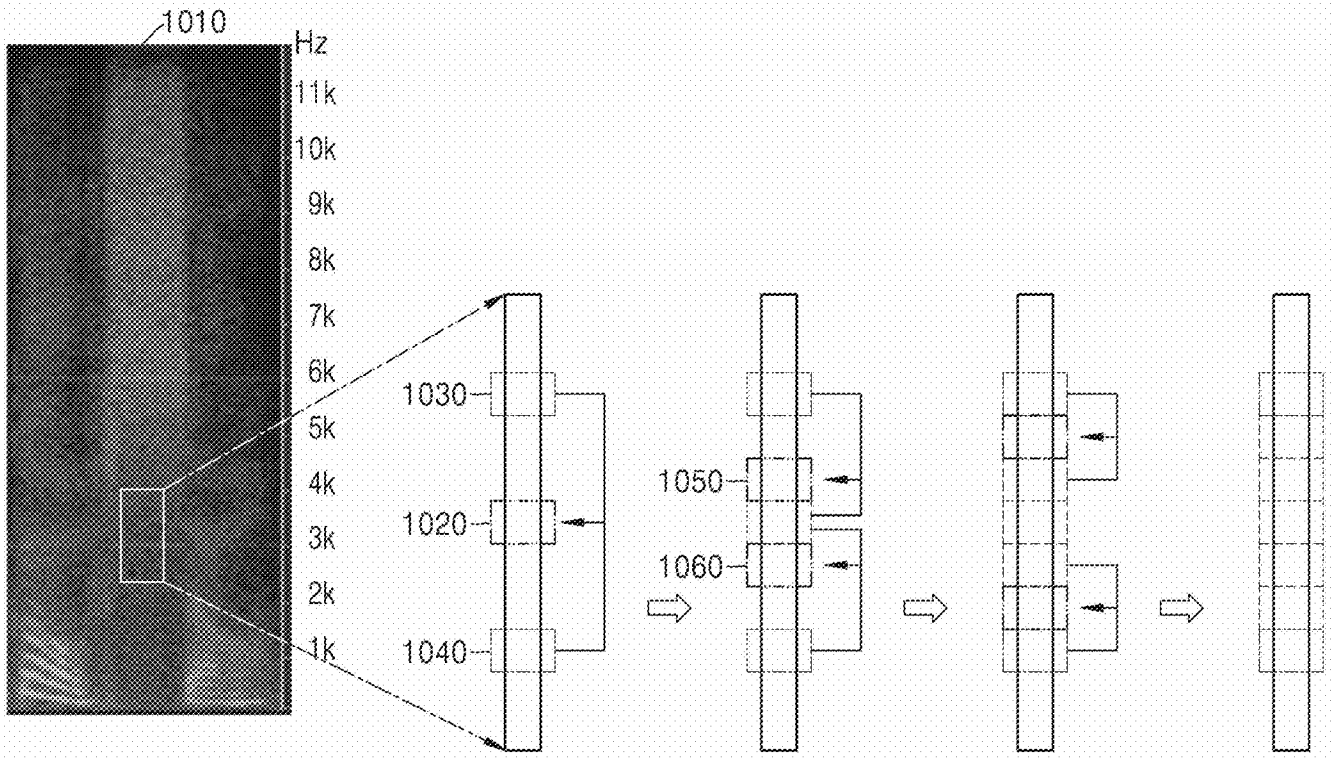
FIG. 10 is a diagram showing an embodiment of removing noise in a speech post-processing unit.

FIG. 10 is a diagram showing an embodiment of removing noise in a speech post-processing unit.

A spectrogram 1010 of FIG. 10 may be generated by performing a STFT on a speech generated by the vocoder 530 of FIG. 5 described above. Meanwhile, the spectrogram 1010 of FIG. 10 may correspond to a part of a spectrogram generated by performing a STFT on a speech generated by the vocoder 530 of FIG. 5 described above. Also, the spectrogram 1010 of FIG. 10 may correspond to a mel-spectrogram.

For example, the speech post-processing unit 540 of FIG. 5 described above may generate a speech signal in the time-frequency domain by performing a STFT on a speech generated by the vocoder 530 and generate the spectrogram 1010 based on the speech signal in the time-frequency domain. Since the speech signal in the time-frequency domain has a complex value, phase information may be lost by obtaining an absolute value of the complex value, thereby generating the spectrogram 1010 including only magnitude information.

Referring to the spectrogram 1010 of FIG. 10, it may be seen that line noise has occurred. For example, the spectrogram 1010 may be a spectrogram generated by performing a STFT on a speech generated by a WaveGlow vocoder, but is not limited thereto.

The speech post-processing unit 540 may perform a post-processing task of removing line noise in the spectrogram 1010 to generate a corrected spectrogram and generate a corrected speech from the corrected spectrogram. The corrected speech may correspond to a speech generated by the vocoder 530, from which noise is removed.

The speech post-processing unit 540 may set a frequency region including a center frequency generating line noise. The speech post-processing unit 540 may generate a corrected spectrogram by resetting the amplitude of at least one frequency within the set frequency region.

Referring to FIG. 10, the speech post-processing unit 540 may set a frequency region including a center frequency 1020 generating line noise. The frequency region may correspond to a region from a second frequency 1040 to a first frequency 1030.

For example, the speech post-processing unit 540 may reset the amplitude of the center frequency 1020 generating line noise to a value obtained by linearly interpolating the amplitude of the first frequency 1030, which corresponds to a frequency higher than the center frequency 1020, and the amplitude of the second frequency 1040, which corresponds to a frequency lower than the center frequency 1020. For example, the amplitude of the center frequency 1020 may be reset to an average value of the amplitude of the first frequency 1030 and the amplitude of the second frequency 1040, but is not limited thereto.

For example, when a STFT with a sampling rate of 24000 and a window length of 0.05 seconds is performed, the spectrogram 1010 of FIG. 10 may have a frequency arrangement of 601 frequency components up to 12000 hz at the interval of 20 Hz. At this time, the center frequency 1020 generating line noise may correspond to, but is not limited to, 3000 Hz corresponding to a 150th frequency of the frequency arrangement, 6000 Hz corresponding to a 300th frequency of the frequency arrangement, 9000 Hz corresponding to a 450th frequency of the frequency arrangement, and 12000 Hz corresponding to a 600th frequency of the frequency arrangement.

For example, when the center frequency 1020 generating line noise in FIG. 10 is 3000 hz corresponding to the 150th frequency in the frequency arrangement, the first frequency 1030 may be 3060 hz corresponding to a 153rd frequency, and the second frequency 1040 may be 2940 hz corresponding to a 147th frequency. At this time, the amplitude of the center frequency 1020 may be reset to a value obtained by linearly interpolating the amplitude of 3060 hz and the amplitude of 2940 hz.

The amplitude of the center frequency generating line noise may be reset as shown in Equation 1 below. In Equation 1 below, S[num_noise] may represent the amplitude of a num_noise-th frequency generation line noise in a frequency arrangement present in the spectrogram 1010, S[num_noise−m] may represent the amplitude of a num_noise−m-th frequency of the frequency arrangement, and S[num_noise+m] may represent the amplitude of a num_noise+m-th frequency in the frequency arrangement.

$$S[\text{num_noise}]=(S[\text{num_noise}-m]+S[\text{num_noise}+m])/2 \quad \text{[Equation 1]}$$

Alternatively, the speech post-processing unit 540 may reset the amplitude of a third frequency 1050 existing between the center frequency 1020 and the first frequency 1030 to a value obtained by linearly interpolating the amplitude of the center frequency 1020 and the amplitude of the first frequency 1030. Also, the speech post-processing unit 540 may reset the amplitude of a fourth frequency 1060 existing between the center frequency 1020 and the second frequency 1040 to a value obtained by linearly interpolating the amplitude of the center frequency 1020 and the amplitude of the second frequency 1040.

For example, when the center frequency 1020 generating line noise in FIG. 10 is 3000 hz corresponding to the 150th frequency and the first frequency 1030 is 3060 hz corresponding to the 153rd frequency, the third frequency 1050 existing between the center frequency 1020 and the first frequency 1030 may be 3040 hz corresponding to a 152nd frequency. In this case, the amplitude of 3040 hz may be reset to a value obtained by linearly interpolating the amplitude of 3000 hz and the amplitude of 3060 hz.

Also, when the second frequency 1040 is 2940 hz corresponding to the 147th frequency, the fourth frequency 1060 existing between the center frequency 1020 and the second frequency 1040 may be 2960 hz corresponding to the 148th frequency. In this case, the amplitude of 2960 hz may be reset to a value obtained by linearly interpolating the amplitude of 3000 hz and the amplitude of 2940 hz.

As described above, the speech post-processing unit 540 may repeatedly perform linear interpolation within a frequency domain including the center frequency 1020 generating line noise. For example, when the center frequency 1020 is 3000 hz corresponding to the 150th frequency in the frequency arrangement, the amplitudes of frequencies existing in the frequency range from 2940 hz corresponding to the 147th frequency to 3060 hz corresponding to the 153th frequency may be reset.

Linear interpolation may be repeated within a frequency domain including a center frequency as shown in Equation 2 below. In Equation 2 below, S[num_noise−k] may represent the amplitude of a num_noise−k-th frequency in the frequency arrangement in the spectrogram 1010, and S[num_noise−m] may represent the amplitude of a num_noise−m-th frequency in the frequency arrangement. Also, S[num_noise−k+1] may represent the amplitude of a num_noise−k+1th frequency in the frequency arrangement, and S[num_noise+k−1] may represent the amplitude of a num_noise+k−1th frequency in the frequency arrangement. Also, m is related to the number of frequencies to be subject to resetting of amplitudes through linear interpolation within a frequency domain including the center frequency.

for k=1 to m, $$S[\text{num_noise}-k]=(S[\text{num_noise}-m]+S[\text{num_noise}-k+1])/2$$

$$S[\text{num_noise}+k]=(S[\text{num_noise}+k-1]+S[\text{num_noise}+m])/2 \quad \text{[Equation 2]}$$

Therefore, the speech post-processing unit 540 may finally generate a corrected spectrogram and may generate a corrected speech signal from the corrected spectrogram. For example, the speech post-processing unit 540 may estimate phase information by repeatedly performing a STFT and an inverse short-time Fourier transform on the spectrogram and generate corrected speech signals based on estimated phase information. In other words, the speech post-processing unit 540 may generate a corrected speech signal from a corrected spectrogram by using the Griffin-Rim algorithm, but the present disclosure is not limited thereto.

Figure 11:
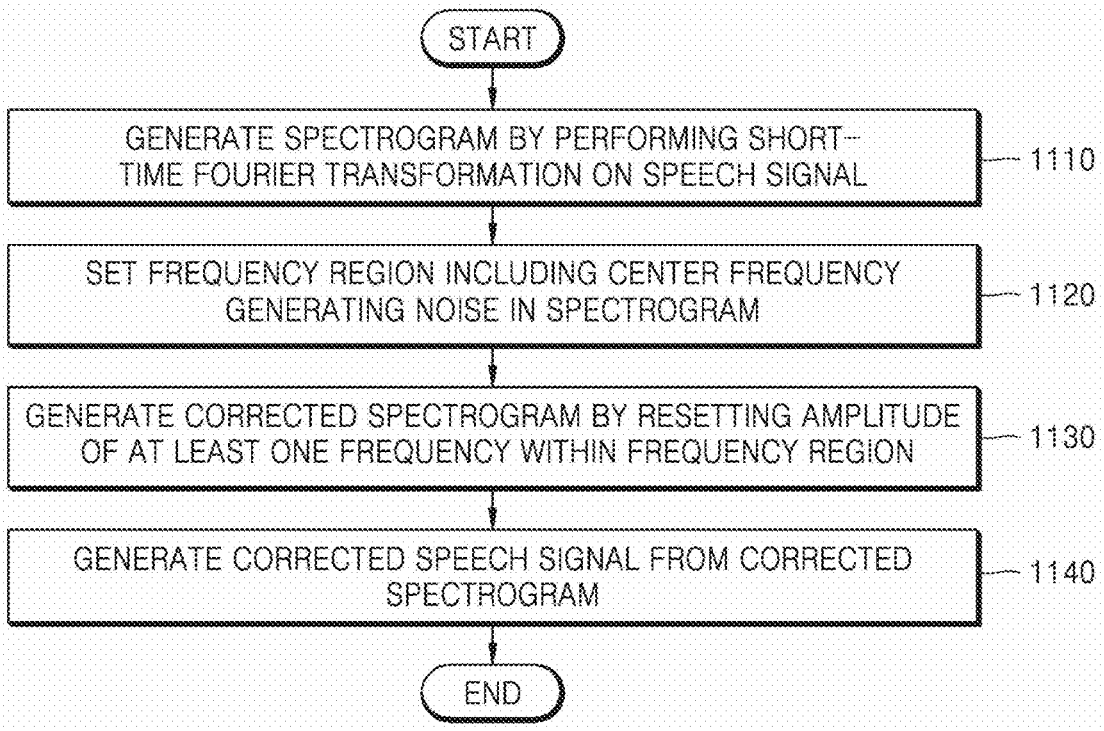
FIG. 11 is a flowchart showing an embodiment of a method of removing noise from a speech signal.

FIG. 11 is a flowchart showing an embodiment of a method of removing noise from a speech signal.

Referring to FIG. 11, in operation 1110, a speech post-processing unit may generate a spectrogram by performing a STFT on a speech signal.

For example, the speech post-processing unit may generate a speech signal in the time-frequency domain by dividing an input speech signal in the time domain into sections having a certain window length and performing a Fourier transformation for each section. Also, the speech post-processing unit may obtain an absolute value of a speech signal in the time-frequency domain, thereby losing phase information and generating a spectrogram including only magnitude information.

In operation 1120, the speech post-processing unit may set a frequency region including a center frequency generating noise in the spectrogram. For example, when the frequency generating line noise in frequency arrangements in the spectrogram is a num_noise-th frequency, the frequency region may correspond to a region from a num_noise−m-th frequency to a num_noise+m-th frequency.

In operation 1130, the speech post-processing unit may generate a corrected spectrogram by resetting the amplitude of at least one frequency within the frequency domain.

For example, the amplitude of the center frequency may be reset to a value obtained by linearly interpolating the amplitude of a first frequency corresponding to a frequency higher than the center frequency and the amplitude of a second frequency corresponding to a frequency lower than the center frequency. For example, the amplitude of the center frequency may be reset to an average value of the amplitude of the first frequency and the amplitude of the second frequency, but is not limited thereto. For example, when the frequency region corresponds to a region from the num_noise−m-th frequency to the num_noise+m-th frequency, the amplitude of the num_noise-th frequency generating line noise may be reset to a value obtained by linearly interpolating the amplitude of the num_noise−m-th frequency and the amplitude of the num_noise+m-th frequency.

Also, the amplitude of a third frequency existing between the center frequency and the first frequency may be reset to a value obtained by linearly interpolating the amplitude of the center frequency and the amplitude of the first frequency, and the amplitude of a fourth frequency existing between the center frequency and the second frequency may be reset to a value obtained by linearly interpolating the amplitude of the center frequency and the amplitude of the second frequency.

In this regard, the speech post-processing unit may repeat linear interpolation to reset the amplitudes of frequencies in the frequency region including the center frequency.

In operation 1140, the speech post-processing unit may generate a corrected speech signal from the corrected spectrogram.

For example, the speech post-processing unit may estimate phase information by repeatedly performing a STFT and an ISTFT on the corrected spectrogram. For example, the speech post-processing unit may generate a corrected speech signal from the corrected spectrogram by using a Griffin-Lim algorithm, but the present disclosure is not limited thereto. The speech post-processing unit may generate a corrected speech signal based on estimated phase information.

Figure 12:
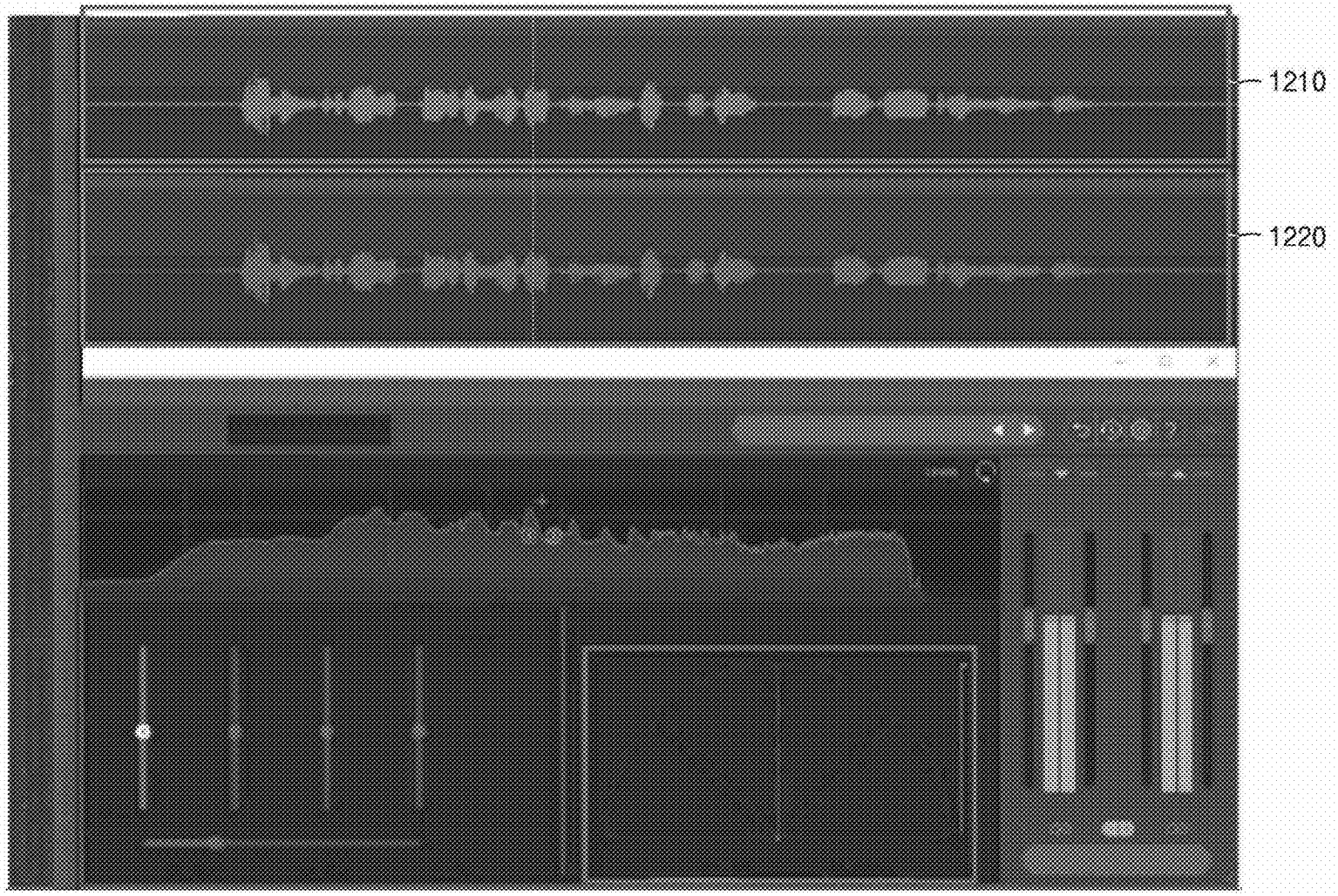
FIG. 12 is a diagram showing an embodiment of performing doubling using an ISTFT.

FIG. 12 is a diagram showing an embodiment of performing doubling using an ISTFT.

The doubling refers to a task of making two or more tracks for vocals or musical instruments. For example, a main vocal is mainly recorded on a single track, but doubling may be performed for an overlapping impression or emphasis. Alternatively, doubling may be performed, such that a chorus recording is heard from the right and the left without interfering with the main vocal.

On the other hand, when the panning of the main vocal is centered and the same chorus sound source is doubled on the right and the left, a user who listens to an entire sound source may receive impression as if the sound is heard only from the center. In other words, when doubling is performed with the same sound source on the right and the left, the entire sound source may become monaural.

Referring to FIG. 12, an original speech signal 1210 may be reproduced on the right. Meanwhile, on the left, a speech signal 1220 generated by performing a STFT on the original speech signal 1210 and then performing an ISTFT may be reproduced.

In this case, the waveform of the original speech signal 1210 reproduced from the right and the waveform of the speech signal 1220 reproduced from the left are almost the same, and thus it may be seen that the entire sound source is heard only from the center. Since the ISTFT restores complex values, which include phase information back to a speech signal as a result of performing the STFT on an original speech signal, the original speech signal may be almost completely restored.

In this regard, when doubling is performed using the ISTFT, since almost the same speech signals are reproduced on the right and the left, the entire sound source may become monaural.

Figure 13:
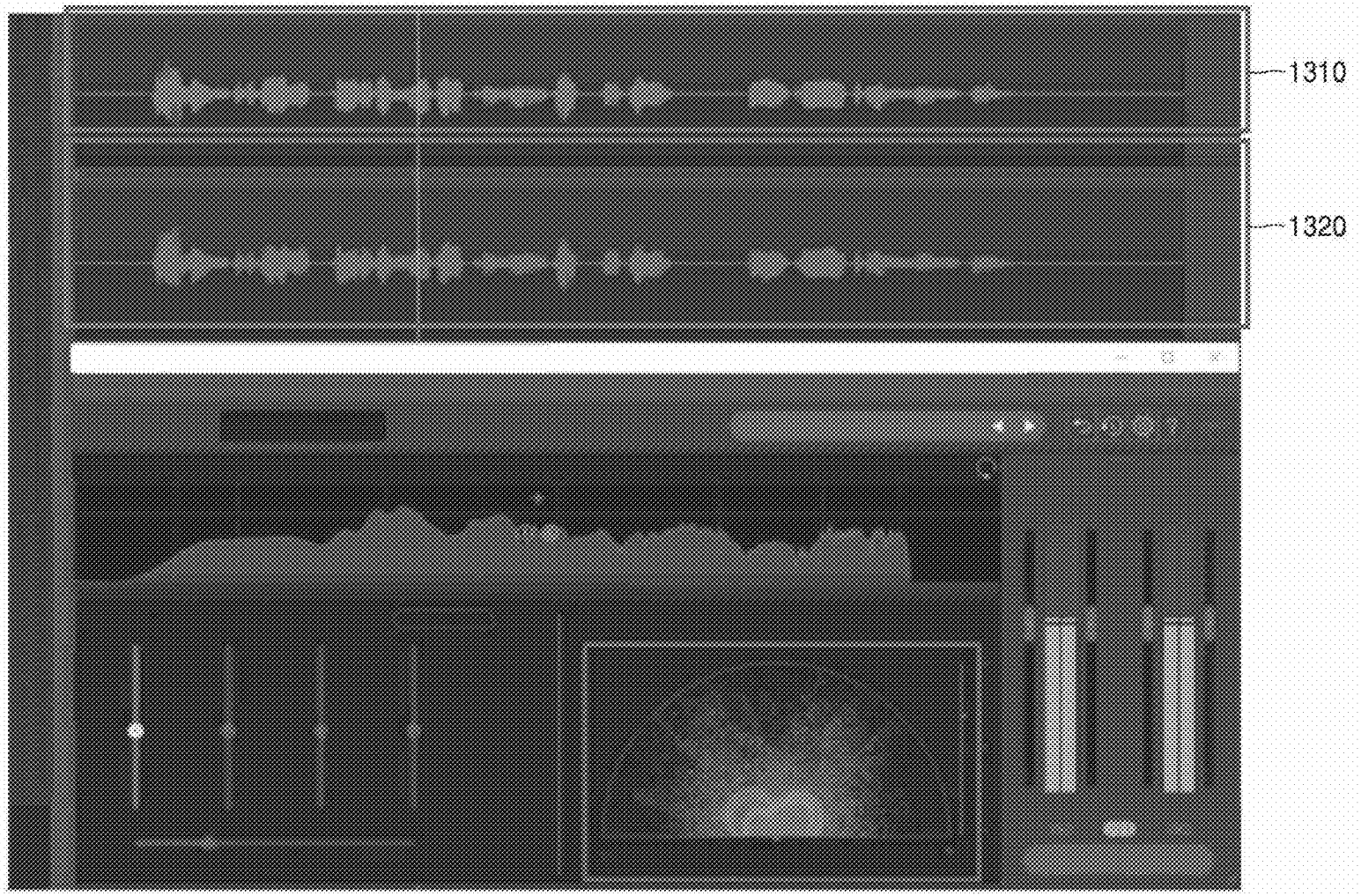
FIG. 13 is a diagram showing an embodiment of performing doubling using the Griffin-Lim algorithm.

FIG. 13 is a diagram showing an embodiment of performing doubling using the Griffin-Lim algorithm.

Referring to FIG. 13, on the right, a first speech signal 1310 in the time domain corresponding to an original speech signal may be reproduced. Meanwhile, on the left, a second speech signal 1320 may be reproduced.

The speech post-processing unit 540 may perform a STFT on the first speech signal 1310 to generate a speech signal in the time-frequency domain. Also, the speech post-processing unit 540 may generate a spectrogram based on the speech signal in the time-frequency domain. For example, since the speech signal in the time-frequency domain has a complex value, phase information may be lost by taking an absolute value for the complex value, thereby generating a spectrogram including only size information.

The speech post-processing unit 540 may generate the second speech signal 1320 in the time domain based on the spectrogram. For example, the speech post-processing unit 540 may estimate phase information by repeatedly performing a STFT and an ISTFT on a spectrogram and generate the second speech signal 1320 in the time domain based on the phase information. In other words, the speech post-processing unit 540 may generate the second speech signal 1320 in the time domain by using the Griffin-Lim algorithm.

For example, the audio post-processing unit 540 may generate a stereo sound source by reproducing the first speech signal 1310 on the right and the second speech signal 1320 on the left. In other words, the speech post-processing unit 540 may form a stereo sound source by summing the first speech signal 1310 and the second speech signal 1320.

Referring to FIG. 13, it may be seen that there is a fine but clear difference between the waveform of the first speech signal 1310 reproduced on the right and the waveform of the second speech signal 1320 reproduced on the left. Therefore, since different sound sources are heard from the right and the left by a user who listens to the entire sound source, the user may enjoy a stereo sound source.

As described above, since doubling is performed by using the first speech signal 1310 and the second speech signal 1320 generated based on the spectrogram of the first speech signal, it is not necessary to perform a recording for doubling twice. Therefore, efficiency of performing doubling may be improved.

Figure 14:
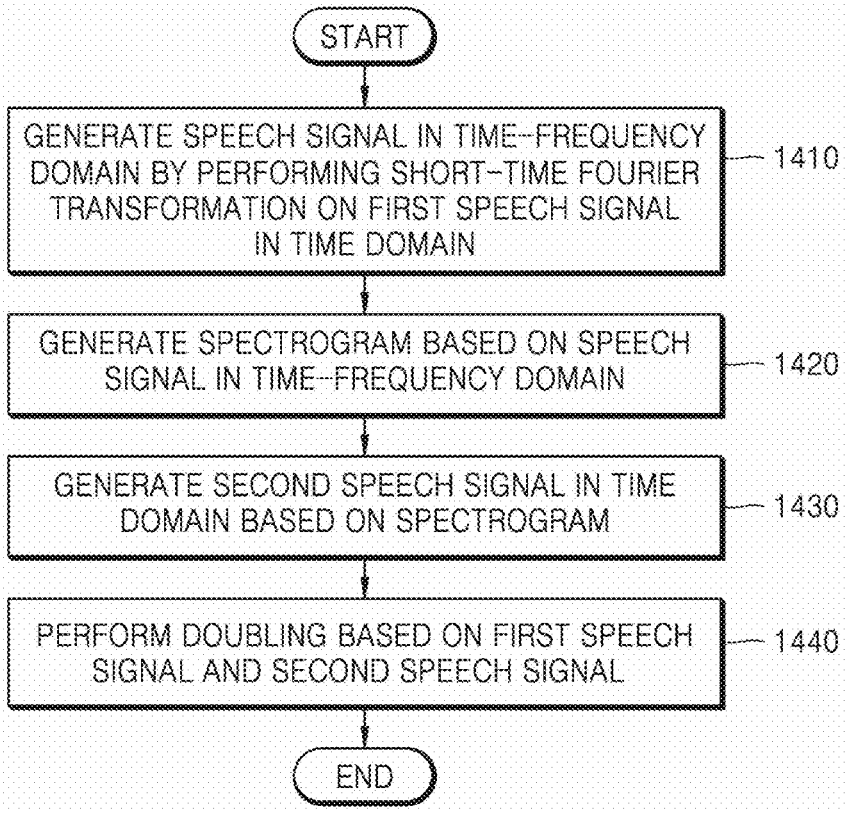
FIG. 14 is a flowchart showing an embodiment of a method of performing doubling.

FIG. 14 is a flowchart showing an embodiment of a method of performing doubling.

Referring to FIG. 14, in operation 1410, a speech post-processing unit may generate a speech signal in the time-frequency domain by performing a STFT on a first speech signal in the time domain.

For example, the speech post-processing unit may divide the first speech signal in the time domain into sections having a certain window length based on a hop length and perform a Fourier transformation for each section. The hop length may correspond to a length between consecutive sections.

In operation 1420, the speech post-processing unit may generate a spectrogram based on the speech signal in the time-frequency domain.

For example, the speech post-processing unit may obtain an absolute value of a speech signal in the time-frequency domain, thereby losing phase information and generating a spectrogram including only magnitude information.

In operation 1430, the speech post-processing unit may generate a second speech signal in the time domain based on the spectrogram.

For example, the speech post-processing unit may estimate phase information by repeatedly performing a STFT and an ISTFT on a spectrogram and generate the second speech signal in the time domain based on the phase information.

In operation 1440, the speech post-processing unit may perform doubling based on the first speech signal and the second speech signal.

For example, when the first speech signal is reproduced on the right and the second speech signal is reproduced on the left, a stereo sound source may be formed as different sound sources are reproduced on the right and the left, respectively.

Various embodiments of the present disclosure may be implemented as software (e.g., a program) including one or more instructions stored in a machine-readable storage medium. For example, a processor of the machine may invoke and execute at least one of the one or more stored instructions from the storage medium. This enables the machine to be operated to perform at least one function according to the at least one invoked command. The one or more instructions may include codes generated by a compiler or codes executable by an interpreter. The machine-readable storage medium may be provided in the form of a non-transitory storage medium. Here the term "non-transitory" only means that the storage medium is a tangible device and does not contain a signal (e.g., electromagnetic waves), and this term does not distinguish a case where data is semi-permanently stored in the storage medium and a case where data is temporarily stored.

In this specification, the term "unit" may refer to a hardware component, such as a processor or a circuit, and/or a software component executed by a hardware configuration, such as a processor.

The above descriptions of the present specification are for illustrative purposes only, and one of ordinary skill in the art to which the content of the present specification belongs will understand that embodiments of the present disclosure may be easily modified into other specific forms without changing the technical spirit or the essential features of the present disclosure. Therefore, it should be understood that the embodiments described above are illustrative and non-limiting in all respects. For example, each component described as a single type may be implemented in a distributed manner, and similarly, components described as being distributed may also be implemented in a combined form.

The scope of the present disclosure is indicated by the claims which will be described in the following rather than the detailed description of the exemplary embodiments, and it should be understood that the claims and all modifications or modified forms drawn from the concept of the claims are included in the scope of the present disclosure.

What is claimed is:

1. A method comprising:

setting sections having a first window length based on a first hop length in a first speech signal;

generating spectrograms by performing a short-time Fourier transformation on the sections;

determining a playback rate and a pitch change rate to change a speed and a pitch of the first speech signal, respectively;

generating speech signals of sections having a second window length based on a second hop length from the spectrograms; and generating a second speech signal of which a speed and a pitch are changed on the speech signals of the sections, wherein a ratio between the first hop length and the second hop length is set to be equal to a value of the playback rate, and wherein a ratio between the first window length and the second window length is set to be equal to a value of the pitch change rate.

2. The method of claim 1, wherein a value of the second hop length corresponds to a preset value, and wherein the first hop length is set to be equal to a value obtained by multiplying the second hop length by the playback rate.

3. The method of claim 1, wherein a value of the first window length corresponds to a preset value, and wherein the second window length is set to be equal to a value obtained by dividing the first window length by the pitch change rate.

4. The method of claim 1, wherein the generating of the speech signals of the sections having the second window length comprises:

estimating phase information by repeatedly performing a short-time Fourier transformation and an inverse short-time Fourier transformation on the spectrograms; and generating speech signals of the sections having the second window length based on the second hop length based on the phase information.

* * * * *